United States Patent [19]

Smith

[11] 4,025,319

[45] May 24, 1977

[54] KNIFE SHARPENER

[76] Inventor: Valy Z. Smith, 4363 W. Dean Road, Brown Deer, Wis. 53223

[22] Filed: Dec. 24, 1975

[21] Appl. No.: 644,100

[52] U.S. Cl. ..... 51/208

[51] Int. Cl.[2] ..... B24B 23/02

[58] Field of Search ..... 51/102, 80 BS, 170 PT, 51/173, 208, 210, 214; 76/82–84

[56] References Cited

UNITED STATES PATENTS

| | | | |
|---|---|---|---|
| 1,426,911 | 8/1922 | Rogers | 51/208 |
| 3,589,214 | 6/1971 | Lindsay | 51/214 X |

FOREIGN PATENTS OR APPLICATIONS

| | | | |
|---|---|---|---|
| 488,636 | 12/1952 | Canada | 51/208 |

*Primary Examiner*—Gary L. Smith
*Attorney, Agent, or Firm*—Fred Wiviott

[57] ABSTRACT

A knife sharpener comprises at least a pair of identical subassemblies and a cooperating housing. Each subassembly includes a planar base member with a pintle shaft projecting obliquely therefrom. An abrasive roller or grinding wheel is journaled on the pintle. Pairs of the subassemblies are arranged in opposed complementary relationship with each other such that the rollers are adjacent each other and angulated to define a passageway through which a knife blade may be drawn for being abraded and sharpened on each side simultaneously by the rollers. Stop means comprising projections from the interior of the housing restrain the rollers on the pintles. The base members are held in complementary relationship with double faced pressure sensitive adhesive strips one face of which adheres to the base members and the other face of which may be pressed on to a mounting surface. The housing makes a press fit with the base members and can be easily removed for cleaning and for inverting the rollers when their original cooperating peripheries become worn. Another embodiment provides for mounting the knife sharpener with a suction device.

9 Claims, 11 Drawing Figures

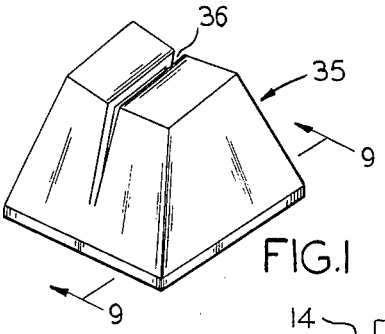
FIG.1
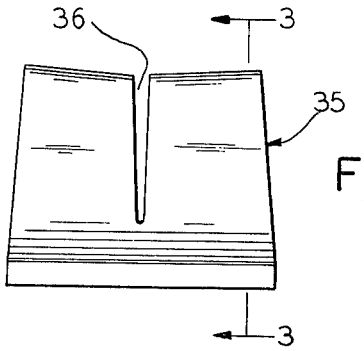
FIG.2
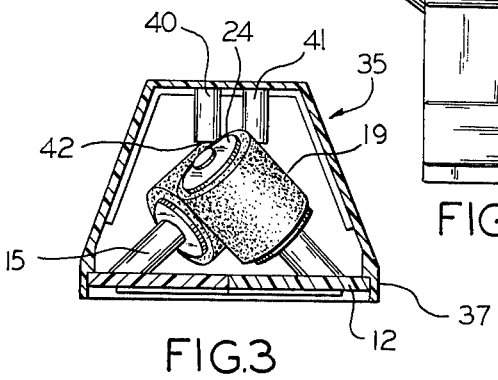
FIG.3
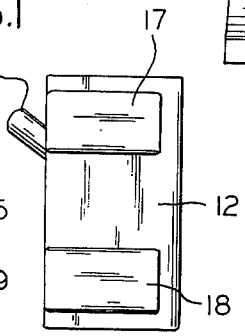
FIG.5
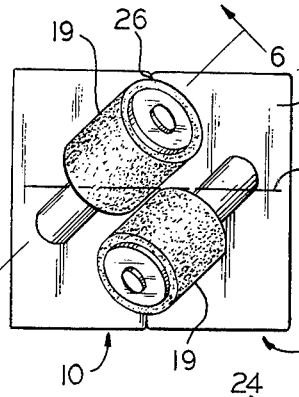
FIG.4
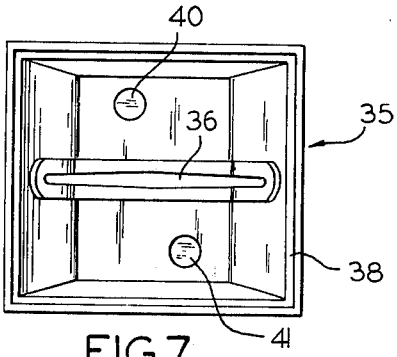
FIG.7
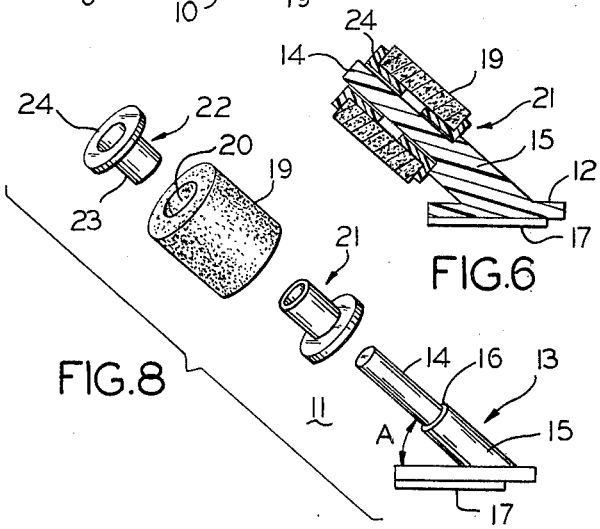
FIG.6
FIG.8
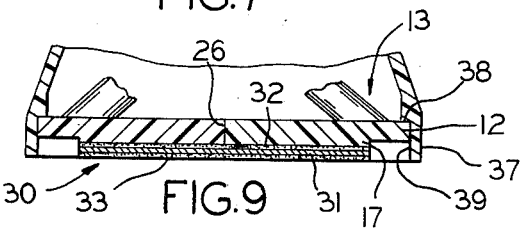
FIG.9
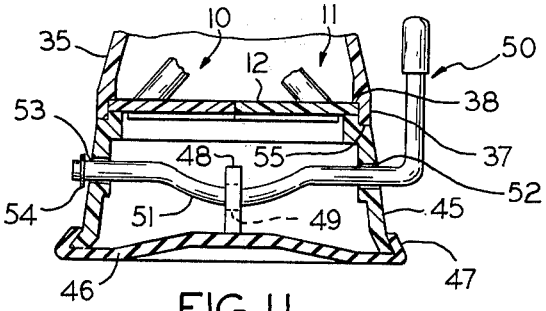
FIG.11
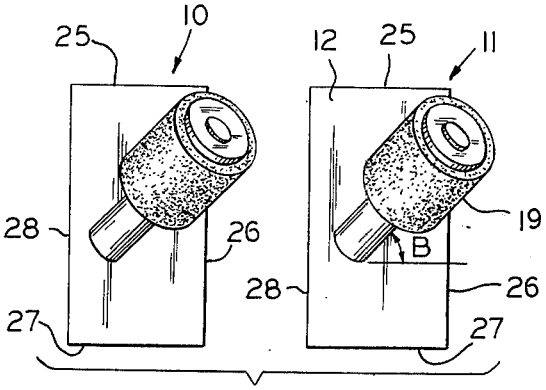
FIG.10

KNIFE SHARPENER

BACKGROUND OF THE INVENTION

This invention is concerned with improving knife sharpeners of the type which use angularly disposed cooperating angulated pairs of abrasive rollers or grinding wheels between which a knife blade may be drawn to sharpen its edge by grinding it toward the cutting edge on both sides simultaneously.

Typical knife sharpeners which the present invention improves are disclosed in U.S. Pat. Nos. 1,426,911, 1,177,821, and 2,544,777. Although prior art knife sharpeners of the general type here under cnsideration could possibly be capable of sharpening knife blades effectively they are not known to have been successful in the market place. Perhaps the main reason for the apparent lack of success in the consumer's market is that prior sharpeners would be costly to produce and would necessarily have a retail sale price that would make then unattractive to customers. Inspection of known prior art reveals that previous sharpener designs require a large number of parts which are costly to manufacture and compel a substantial number of assembly operations such as applying nuts and washers and peening the ends of shafts and so forth. Moreover, there is no suggestion in the prior art as to how the designs can be altered to reduce the number of parts and, hence, to simplify assembly nor to enable mass manufacture such as by using molded parts primarily.

SUMMARY OF THE INVENTION

The present invention is distinguished by using one basic type of subassembly and arranging pairs of such subassemblies in cooperating complementary relationship to form the basic knife sharpening device. Each subassembly comprises a planar base from which an integrally molded pintle shaft projects at an oblique angle. The pintles are shouldered and have a straight shaft portion extending from the shoulder on which an abrasive grinding wheel or roller is journaled. When corresponding margins or edges of the planar bases are placed in abutting relationship, the rollers diverge from each other and their peripheries form a V-shaped passage through which the knife blade may be drawn to effect simultaneous grinding of the opposite side of its edge. In one embodiment, the planar bases are held in abutting relationship with one or more strips of material having pressure sensitive adhesive on opposite surfaces. One of the adhesive surfaces bonds with the bottoms of the bases to hold these subassemblies together as a unit. The unit may then be pressed onto a wall or other smooth mounting surface for being held by the other adhesive surface. A housing having a knife receiving slot therein is adapted to engage the bases with a press fit so it is easily installed and removed. The interior of the housing has integral projections which extend toward the grinding rollers and retain them on the pintles when the cover is in place so that snap rings, nuts and pins which are usually used for retaining the rollers are unnecessary. The housing can be easily removed to permit sliding the rollers from the pintles and inverting them to obtain new cooperating grinding peripheral surfaces after one end of the rollers have become worn.

The grinding rollers are journaled on the pintles with flanged bushings made of anti-friction material. The stops, which project from the interior of the housing and prevent the roller from moving axially on the pintles except for a small free-play, act on the flanges of the bushing and not on the abrasive rollers.

In another embodiment, the sharpener is mounted on a frame like support which can be attached to a mounting surface with a suction device. In this embodiment, the bases of the subassemblies rest on the edge of the support and they are held in place by the housing which has a shouldered edge that interlocks with the bases and the edge of the support. The bases may be further secured to the support edges with an adhesive.

Accordingly, an object of this invention is to provide a knife sharpener, having the features outlined above, which sharpens knife blades quickly and effectively and yet is of such simple construction that it may be made with high production methods and sold at a low price.

A further object is to provide a knife sharpener that is composed of identical subassemblies which may be arranged in reversed complementary relationship to form an operative knife sharpener so the number of different parts that must be manufactured are minimized.

Another object is to provide a knife sharpener design that is adapted for using molding techniques to make a minimum number of multifunctional identical parts which can be quickly and directly assembled into a knife sharpener without using tools.

Yet another object is to provide a knife sharpener that has the operative components on similar bases which are held in abutting relationship with double-faced pressure sensitive adhesive strips such that the strips may perform the dual purposes of holding the bases together as an assembly and of facilitating mounting the bases on a supporting surface.

Another object is to provide a knife sharpener of the type described above wherein the grinding rollers are retained on their shafts or pintles by simple stops which project from the interior of the housing of the sharpener.

A still further object is to provide a knife sharpener from which the housing may be removed while the operative components of the knife sharpener remain adhered to a supporting surface so the grinding rollers may be conveniently removed and inverted to provide new unworn grinding surfaces and to provide for substitution of new rollers.

How the foregoing and other more specific objects of the invention are achieved will appear in the ensuing more detailed description of a preferred embodiment of the invention taken in conjunction with the drawing.

DESCRIPTION OF THE DRAWING

FIG. 1 is a perspective view of the knife sharpener with its housing in place;

FIG. 2 is an end elevation of the sharpener looking into the central knife blade receiving slot;

FIG. 3 is a vertical section taken on the line corresponding with 3—3 in FIG. 2;

FIG. 4 is a plan view of the operative components of the knife sharpener from which the housing has been removed;

FIG. 5 is a bottom view of a base member on which operative components of the sharpener are mounted;

FIG. 6 is a sectional view through the base member and one of the roller assemblies taken on a line corresponding with 6—6 in FIG. 4;

FIG. 7 is an inside bottom view of the knife sharpener housing;

FIG. 8 is an exploded view of a subassembly comprising a base, integral pintle, bushings and a grinding roller;

FIG. 9 is a partial vertical sectional view taken along a line corresponding with 9—9 in FIG. 1;

FIG. 10 shows a pair of similar subassemblies for the knife sharpener before they are placed in abutting complementary relationship as they are in FIG. 4; and FIG. 11 is a partial vertical section of an alternative embodiment of the knife sharpener which is adapted for being fastened to a mounting surface with a suction device.

DESCRIPTION OF A PREFERRED EMBODIMENT

Two basic subassemblies with which the knife sharpener is composed are shown in FIG. 10 and are identified by individual reference numerals 10 and 11 even though the subassembiies are identical. FIGS. 6, 8 and 10 illustrate how a subassembly such as the one marked 11 is comprised of a planar and rectangular molded base 12 which has a unitarily molded pintle means 13 projecting from it. Pintle means 13 comprises a straight shaft portion 14 and an enlarged portion 15 which cooperate to define a shoulder 16. The base 12 also has a pad or boss 17 molded integrally with it. A plan view of boss 17 and a similar boss 18 may be seen in FIG. 5 which shows how the base 12 appears from the bottom.

Base 12, boss 17 and pintle 13 are molded as a unitary part from resin. A suitable form and temperature stable thermoplastic resin which has been used is one identified generically as ABS resin a particular brand of which is available under the trademark Cycolac. Other thermoplastic or thermosetting resins having form and temperature stability may be used too.

Mounted on the straight shaft portion 14 of pintle 13 is an abrasive roller or grinding wheel 19. Roller 19 is cylindrical and has a central bore 20 into which flanged bushings such as 21 and 22 are press fit. A typical bushing 22 has a sleeve portion 23 and an integral flange 24. The bushing is preferably made of nylon or other suitable tough anti-friction material since it is desirable that the bushings fit quite closely on pintle shaft 14 but, nevertheless, permit the roller 19 to turn freely during the knife sharpening operation which will be described.

It will be noted that pintle member 13 projects obliquely from base member 12, that is, the pintle is neither perpendicular to nor parallel to planar base 12. The pintle preferably makes an angle A of about 45° relative to the planar base as shown in FIG. 8. The pintle is also preferably turned sidewise or askew through an angle B of about 22½° as can be seen in FIG. 10.

Viewing the planar bases 12 from the top as in FIG. 10, one may see that the bases have four straight margins or edges which are marked 25–28 and that the edges define a rectangular base in this embodiment.

The basic knife sharpener assembly shown in FIG. 4 is made up of two identical subassemblies such as either of the ones marked 10 and 11 in FIG. 10. FIG. 4 shows the bases 12 of the subassemblies arranged with their corresponding margins or edges 26 in abutting relationship and coplanar. By placing the subassemblies as in FIG. 4, the peripheries of abrasive rollers 19 are nearly in contact with each other but are so angulated to provide a V-shaped passageway the central plane of which is marked with a dashed line 29. The blade of a knife is moved back and forth along this plane during the sharpening process so that the peripheries of the cooperating grinding rollers 19 may engage the blade edge on opposite sides and grind the blades to the desired angle.

The subassemblies 10 and 11 shown in FIG. 4 are held together with a pair of double faced adhesive strips 30 which can be seen in section in FIG. 9. Strip 30 comprises a tape 31 on the upper surface of which is an adhesive layer 32 and on the lower face of which there is an adhesive layer 33. The adhesive is preferably a pressure sensitive type. The upper adhesive 32 is adhered to the bottom surface of bosses 17 on the respective planar bases 12 so as to secure the bases together with their corresponding margins 26 abutting as shown in FIG. 9. The pair of adjoining bases 12 may then be adhered to a smooth mounting surface such as a wall, door or tabletop by pressing the subassembly on such surface and adhering them with adhesive coating 33.

A housing 35 having substantially the shape of a truncated pyramid is provided for concealing the abrasive rollers. As can be seen in FIGS. 1, 2 and 7, housing 35 has a slot 36 through which a knife blade may be drawn along the plane 29 in FIG. 4 during the blade sharpening process. Housing 35 snaps on and makes a press fit between it and abutting bases 12. As can be seen particularly well in FIGS. 3 and 9, the side walls of the housing terminate in a straight depending lip 37 on which there is an internal shoulder 38 and a straight interior surface 39 which extends perimeterally around the housing so that the outside margins 28 and the opposite margins 25 and 27 of the bases 12 are frictionally engaged between the lips 37. Consequently, housing 35 may be easily pressed on and removed from the bases when the latter are adhered to a mounting surface.

In FIG. 3, where the housing 35 is shown in place on bases 12, one may see that there are a pair of projections 40 and 41 extending integrally from the top interior of housing 35 toward the end of the cylindrical rollers 19. These projections constitute stop means for retaining the abrasive rollers on the pintles for any mounting orientation of the device. The tip or end 42 of a projection is preferably slightly spaced from the anti-friction flange 24 of the roller bushings to allow the rollers to have a little axial free play before they are stopped by the tips of the projections. During the knife sharpening process, of course, the pressure of the knife blades urges the rollers toward shoulder 16 on the pintles 13.

Housing 35 is molded unitarily with projections 40 and 41 formed integrally from the top of the housing. The housing is also desirably molded from an impact resistant and form stable resin such as the ABS resin with which the base and pintle assemblies are molded. The walls of the housing are slanted so as to not be struck by the knife handle until the end of the blade nearest the handle is close to the grinding rollers whereby substantially the full length of the blade may be sharpened.

When the abrasive rollers 19 becomes worn or grooved as they may in time due to grinding a knife edge in substantially the same place along their peripheries, they can easily be restored to usefulness by inverting them on their pintles. In accordance with the invention, it is only necessary to remove housing 35 in which case the rollers are free to be slid off of the pintles since stop means 40 and 41 are moved out of the way by removal of the housing. The rollers may then be inverted and the housing replaced. New rollers may also be substituted by following the same procedure. Thus, normally there should be no need for prying the adjoining subassemblies 10 and 11 off of the surface on which they are mounted.

The basic knife sharpener assembly described above can also be mounted on a smooth surface with a suction device as suggested in FIG. 11. In this figure, the housing 35 and the bases 10 and 11 are assembled as they were in the device described heretofore. However, a hollow rectangular support frame 45 is provided to which the housing 35 is frictionally engaged. Hollow support 45 has an open rectangular bottom which is enclosed by a conventional flexible rubber diaphragm 46 which has turned up margins 47 in sealing relation with the lower perimeteral edges of support 45. Diaphragm 46 has an upstanding post or link 48 attached to it. A crank 50 having a central eccentric portion 51 passes through hole 49 in the link. The crank is journaled in bores 52 and 53 in the support frame and is retained against axial movement by a snap ring 54. When the crank is turned while diaphragm 46 is pressed against a smooth surface, the diaphragm is retracted upwardly to create a vacuum or suction which causes the support frame 45 to adhere to a smooth surface. The lower margin of housing 35 has the depending lip 37 used in the previously described design. The interior of the lip has a shoulder 38 which permits pressure engagement with the base members 12 of the subassemblies 10 and 11. The upper perimeter of the support frame 45 also has a shoulder 55 which enables the support frame, the bases 12 and housing 35 to be interlocked or in frictional engagement with each other to assure that no part of the assembly separates during use. The margins of the bases 12 may also be fixed to the upper edge of the support frame 45 with adhesive if desired. This still permits housing 35 to be disengaged from the parts which are fixed on the mounting surface.

Although the invention has been described with specific reference to the structure shown in the accompanying drawing, it is not to be limited thereby except as required by construction of the following claims.

I claim:

1. A knife sharpener comprising:

similar individual subassemblies each including a generally planar molded base, pintle means molded integrally with said base and projecting obliquely therefrom, and an abrasive roller means journaled for rotation solely on said pintle means, a pair of said subassemblies being arranged with their bases adjacent each other in reverse complementary relationship to dispose said roller means proximate to each other and in oppositely angulated relationship to define a passage through which a knife blade that is to be sharpened may be drawn in contact with each of said abrasive roller means, and molded housing means constructed and arranged for engaging with said bases jointly and for concealing said roller means, said housing means having a slot aligned with said passage to enable drawing a knife against said roller means.

2. The knife sharpener as in claim 1 including stop means for prohibiting said roller means from sliding axially off of said pintle means, said stop means being molded integrally with said housing means and projecting from the interior of said housing means and terminating in spaced relationship with said pintle means and in proximity with said roller means but offset from the axis thereof when said housing is engaged with said bases.

3. The knife sharpener as in claim 2 wherein said pintle means includes shoulder means for restraining said roller means against axial movement toward said base and said pintle means includes a substantially uniform diameter shaft portion for enabling uninhibited manual removal and replacement of said roller means relative to said pintle means when said housing means is disengaged and separated from said bases.

4. The knife sharpener as in claim 2 including bushing means in said roller means for journaling said roller means on said pintle means, said bushing means having an integral radially extending non-abrasive flange contiguous with said roller means, said stop means being in proximity with said flange when said housing means is engaged with said bases.

5. A knife sharpener comprising:

similar individual subassemblies each including a generally planar molded base, pintle means molded integrally with said base and projecting obliquely therefrom, and an abrasive roller means journaled for rotation solely on said pintle means, a pair of said subassemblies being arranged with their bases adjacent each other in reverse complementary relationship to dispose said roller means proximate to each other and in oppositely angulated relationship to define a passage through which a knife blade that is to be sharpened may be drawn in contact with each of said abrasive roller means, and molded housing means constructed and arranged for engaging with said bases jointly and for concealing said roller means, said housing means having a slot aligned with said passage to enable drawing a knife against said roller means, at least one strip of material having opposite surfaces and extending from one to another of said bases, one of said surfaces being adhered to each of said bases for holding them in complementary relationship and the opposite one of said surfaces being for accommodating an adhesive for adhering said bases to a mounting surface, to enable said housing means to be engaged with and disengaged from said bases while said subassemblies remain in place on said mounting surface.

6. A knife sharpener comprising:

similar individual subassemblies each including a generally planar molded base, pintle means molded integrally with said base and projecting obliquely therefrom, and an abrasive roller means journaled for rotation solely on said pintle means, a pair of said subassemblies being arranged with their bases adjacent each other in reverse complementary relationship to dispose said roller means proximate to each other and in oppositely angulated relationship to define a passage through which a knife blade that is to be sharpened may be drawn in contact with each of said abrasive roller means, and molded housing means constructed and arranged for engaging with said bases jointly and for concealing said roller means, said housing means having a slot aligned with said passage to enable drawing a knife against said roller means, support means comprising means for engaging said support means with a smooth surface to thereby fixedly mount said knife sharpener for use, said support means having perimetral edges arranged to be spaced from said smooth surface, said edges having a shoulder, said housing means having edges including a lip portion and a shoulder defining an opening, said bases being engaged between said shoulders, said housing and said bases being frictionally engageable with said shoulder on said support means edge.

7. A knife sharpener comprising:

at least a pair of generally planar similar molded bases having corresponding margins, a pintle molded integrally with each of said bases and inseparable therefrom, each of said pintles projecting from said bases at similar angles relative to the plane of its respective base and to a longitudinal plane that is substantially perpendicular to said base, said bases being arranged substantially coplanar with their corresponding margins adjacent each other and with the pintle of one base being directed generally opposite of and in spaced relationship with the pintle of the other base so that each pintle diverges at the same angle away from said longitudinal plane, a roller comprising abrasive material journaled for rotation solely on each of said pintles and coaxial therewith with the peripheries of said rollers being adjacent each other such that they may grind simultaneously the opposite sides of the edges of a knife drawn along said longitudinal plane and in contact with said rollers, a unitary molded housing having a slot for admitting a blade into contact relation with said rollers, said housing being constructed and arranged for engaging said bases jointly to secure said housing thereto, and stop means molded integrally with said housing and projecting from the interior of said housing toward said rollers for retaining and rollers on said pintles when said housing is engaged with said bases.

8. The knife sharpener as in claim 7 including at least one strip of material having opposite surfaces, on at least one of which surfaces there is adhesive for adhering to said bases and thereby joining said bases in abutting relationship.

9. The knife sharpener as in claim 8 wherein the other of said surfaces of said strip has adhesive material thereon for securing said bases onto a mounting surface.

* * * * *

UNITED STATES PATENT OFFICE

CERTIFICATE OF CORRECTION

Patent No. 4,025,319 Dated May 24, 1977

Inventor(s) Valy Z. Smith

It is certified that error appears in the above-identified patent and that said Letters Patent are hereby corrected as shown below:

Claim 7, Column 8, line 17, cancel "and" and substitute --said--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*